US005829078A

United States Patent [19]

Rivers

[11] Patent Number: 5,829,078

[45] Date of Patent: Nov. 3, 1998

[54] RESCUE SHUTTLE

[76] Inventor: Gregory W. Rivers, 4327 Montgomery Crescent, Prince George, British Columbia, Canada, V2K 2E4

[21] Appl. No.: 921,563

[22] Filed: Sep. 2, 1997

[51] Int. Cl.[6] ..... A61G 1/00

[52] U.S. Cl. ..... 5/629; 5/625; 5/628

[58] Field of Search ..... 5/625, 626, 627, 5/628, 629

[56] References Cited

U.S. PATENT DOCUMENTS

| | | | |
|---|---|---|---|
| D. 251,442 | 3/1979 | Broom et al. | D24/99 |
| 3,135,972 | 6/1964 | Jakes et al. | 5/629 |
| 3,348,245 | 10/1967 | Schindler | 5/629 |
| 3,811,139 | 5/1974 | Shaw | 5/629 X |
| 4,023,219 | 5/1977 | Shindler | 5/82 R |
| 4,183,110 | 1/1980 | Kidd et al. | 5/82 R |
| 4,347,635 | 9/1982 | Eisenhauer | 5/626 X |
| 5,398,358 | 3/1995 | Mercke et al. | 5/625 |
| 5,494,051 | 2/1996 | Schneider, Sr. | 128/870 |

FOREIGN PATENT DOCUMENTS

| | | | |
|---|---|---|---|
| 2041764 | 9/1980 | United Kingdom | 5/627 |

*Primary Examiner*—Michael F. Trettel

*Attorney, Agent, or Firm*—Antony C. Edwards

[57] ABSTRACT

The rescue shuttle of the present invention includes upper and lower elongate cowlings. The lower enclosure cowling is adapted for carrying a patient. The lower enclosure cowling has a generally horizontal aperture defined by an upper edge thereof. The elongate upper enclosure cowling is releasably mountable on to the lower enclosure cowling around the upper edge of the lower enclosure cowling so as to cover the lower enclosure cowling. The lower enclosure cowling has laterally opposed first and second sides. The first side and the second side have a corresponding first rigid member and second rigid member extending longitudinally there along, rigidly mounted to the first side and second side respectively. The first and second sides have a plurality of channels, pockets, grooves or apertures in spaced longitudinal array there along so as to provide corresponding strap mounting locations on the first and second rigid members for mounting of straps thereto. A plurality of slinging straps are mountable to the first and second rigid members in longitudinally spaced apart array for releasable suspension of said rescue shuttle beneath a helicopter. A plurality of false floor supporting members are also mountable to the first and second rigid members so as to extend between said first and second rigid members in longitudinally spaced array. A rigid false floor is mountable onto the plurality of false floor supporting members.

11 Claims, 6 Drawing Sheets

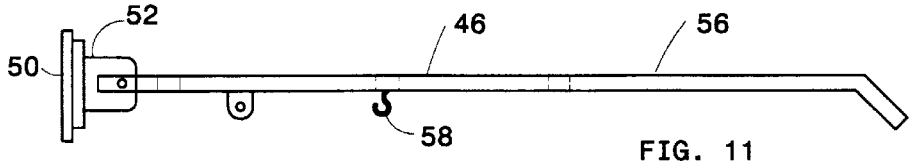
FIG. 11
FIG. 9
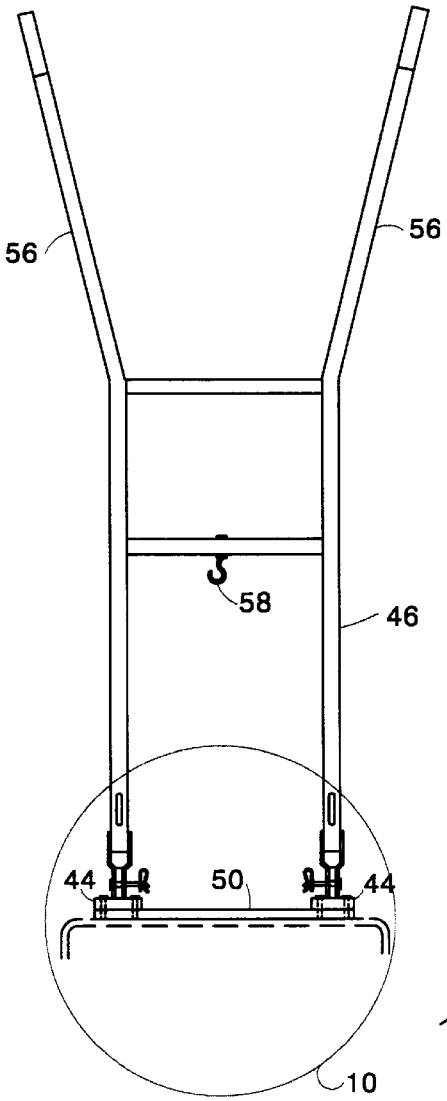
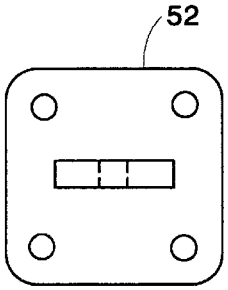
FIG. 12
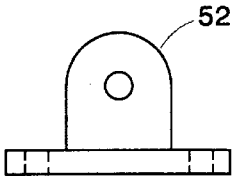
FIG. 13
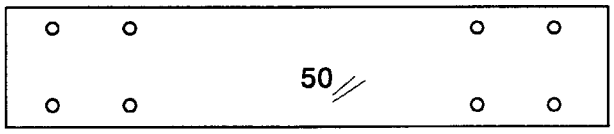
FIG. 14
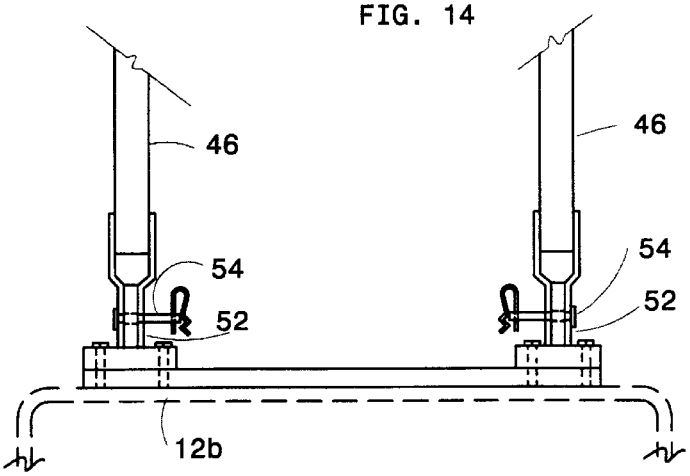
FIG. 10

RESCUE SHUTTLE

FIELD OF THE INVENTION

This invention relates to the field of transportable personnel carrying containers and, in particular, a rescue shuttle for transporting and airlifting injured personnel along with associated medical equipment.

BACKGROUND OF THE INVENTION

The rescue shuttle of the present invention is a transportable personnel carrying container designed primarily for rescue operations evacuating those seriously incapacitated. Currently existing evacuation toboggans, stretchers and the like have the drawback that the patient is exposed to the elements. Such exposure can be life threatening particular in instances where the patient must be evacuated by helicopter from locations where the helicopter cannot land and so the patient must be extracted on the end of lanyard or sling. Further, typical rescue toboggans, stretchers and the like do not have provisions for securely carrying medical equipment such as medical breathing oxygen and other health monitoring devices. Further, such prior art typically is not designed to be suspended below a helicopter and, in particular, no such prior art devices have, to the knowledge of the applicant, being credited with a certificate of air worthiness.

In the prior art, applicant is aware of U.S. Pat. No. 4,183,110 which issued to Kidd et al on Jan. 15, 1980 for a Casualty Transfer System. The Kidd device is a reinforced plastic body shell having a removable lid for covering all but the head of a patient. The exterior of the shell has lifting handles, lugs and towing eyes to facilitate lifting and handling. The lifting handles, lugs and towing eyes are all directly connected to the shell so that the shell bears the load of the patient being transported. What is neither taught nor suggested is the use of a false floor supported by straps or webbing strung laterally underneath the false floor where the straps or webbing are secured at their ends on either side of the cowling shell to an opposed pair of longitudinally extending rods, the cowling shell depending from the rods so as to thereby remove the loading stress from the cowling shell.

SUMMARY OF THE INVENTION

The rescue shuttle of the present invention includes upper and lower elongate cowlings. The lower enclosure cowling is adapted for carrying a patient. The lower enclosure cowling has a generally horizontal aperture defined by an upper edge thereof. The elongate upper enclosure cowling is releasably mountable on to the lower enclosure cowling around the upper edge of the lower enclosure cowling so as to cover the lower enclosure cowling. The lower enclosure cowling has laterally opposed first and second sides. The first side and the second side have a corresponding first rigid member and second rigid member extending longitudinally there along, rigidly mounted to the first side and second side respectively. The first and second sides have a plurality of channels, pockets, grooves or apertures in spaced longitudinal array there along so as to provide corresponding strap mounting locations on the first and second rigid members for mounting of straps thereto.

A plurality of slinging straps are mountable to the first and second rigid members in longitudinally spaced apart array for releasable suspension of said rescue shuttle beneath a helicopter. A plurality of false floor supporting members are also mountable to the first and second rigid members so as to extend between said first and second rigid members in longitudinally spaced array. A rigid false floor is mountable onto the plurality of false floor supporting members.

In particular, the first and second sides have corresponding first and second side surfaces which extend in a longitudinal direction and which are each laterally displaced so as to form the channels, pockets, grooves or apertures in a plurality of longitudinally spaced apart locations so as to expose the first and second rigid members. A first set of the longitudinally spaced apart locations expose the first and second rigid members to the exterior of the lower enclosure cowling. A second set of the longitudinally spaced apart locations expose the first and second rigid members to the interior of the lower enclosure cowling. At the first set of the longitudinally spaced apart locations the first and second rigid members provide means for manual lifting of the rescue shuttle and means for releasably mounting a sling means to the rescue shuttle for vertical lifting of the rescue shuttle. At the second set of longitudinally spaced apart locations the first and second rigid members provides means for suspending within the lower enclosure cowling, a false floor, or Gill panel from the first and second rigid members.

A patient restraint may be mounted to the false floor for releasable restraining of the patient on the false floor within the lower enclosure cowling between the first and second rigid members. Advantageously, the means for suspending a false floor from the first and second rigid members are a plurality of longitudinally spaced apart flexible tensile members, such as flexible straps or webbing, mounted to the first and second rigid members at the second set of longitudinally spaced apart locations and mounted to the false floor. Further advantageously, the flexible tensile members are straps or webbing which depend downwardly from, so as to extend between, the first and second rigid members and beneath the false floor so as to extend laterally across the lower enclosure cowling.

In a preferred embodiment, medical equipment is mounted, and may be releasably mounted, or is mountable within the lower enclosure cowling, the medical equipment advantageously located or locatable at one end of the lower enclosure housing, preferably corresponding to the end enclosing the head of the patient and forming the leading edge of the rescue shuttle when in flight.

In a preferred embodiment, advantageously, a retaining collar, clip, pin or the like may be provided at either end of rigid members.

BRIEF DESCRIPTION OF THE DRAWINGS

FIG. 9 is, in plan view, a releasably mountable attachment to the rescue shuttle of FIG. 1.

FIG. 10 is an enlarged view of the mounting means of FIG. 9.

FIG. 11 is, in side elevation view, the attachment of FIG. 9.

FIG. 12 is, in front elevation view, the tow eye of FIG. 10.

FIG. 13 is, in side elevation view, the tow eye of FIG. 12.

FIG. 14 is, in front elevation view, the plate of FIG. 10.

DETAILED DESCRIPTION OF PREFERRED EMBODIMENTS

Figure 1:
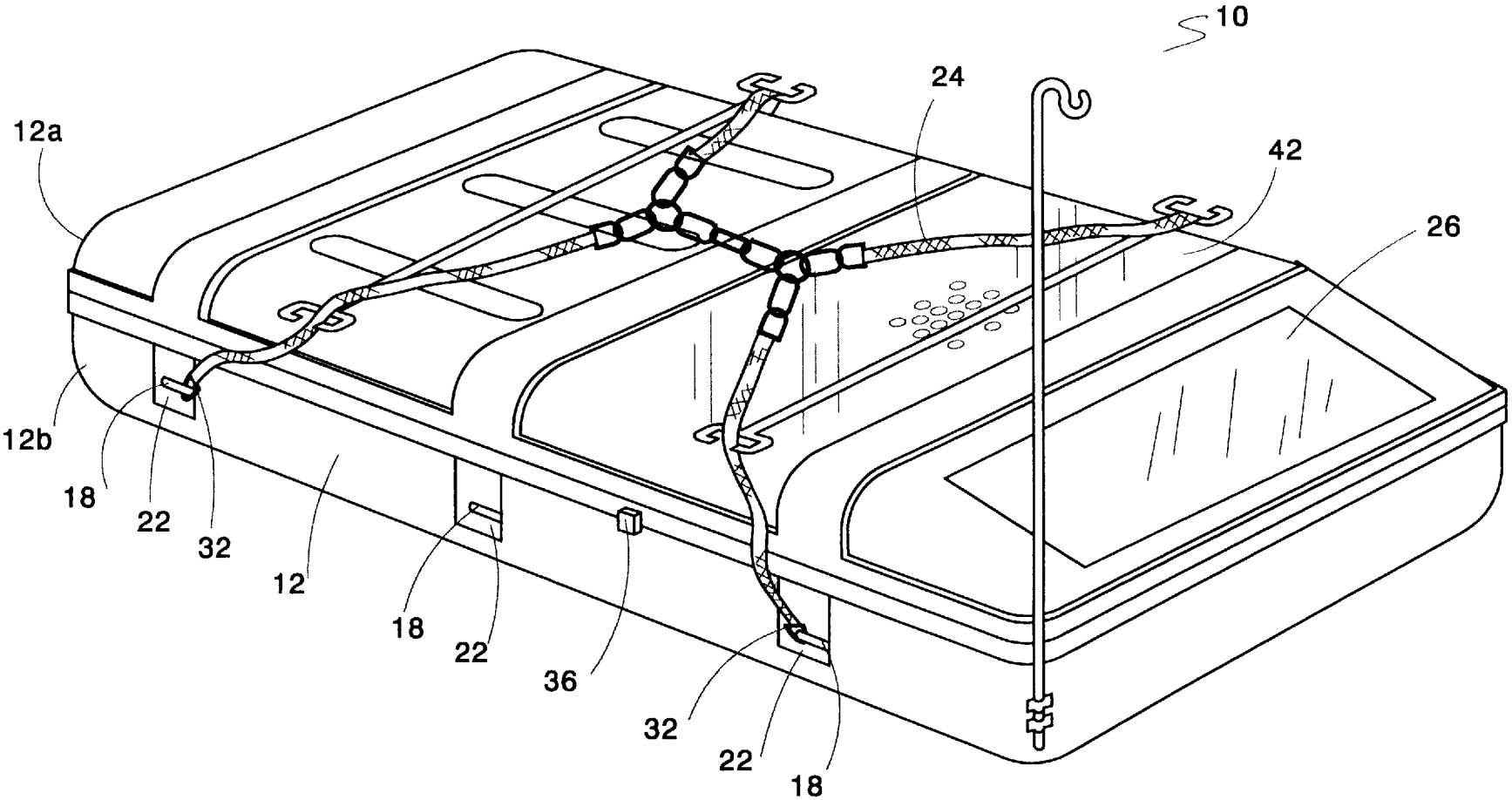
FIG. 1 is, in perspective view, the rescue shuttle of the present invention.
Figure 3:
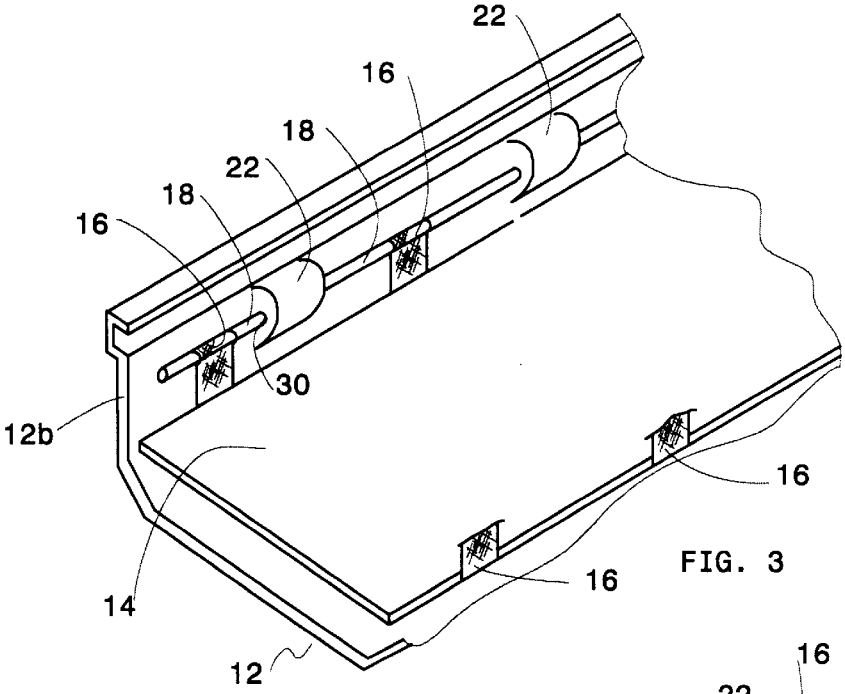
FIG. 3 is, in partially-cutaway, perspective view, the lower enclosure of FIG. 2.
Figure 2:
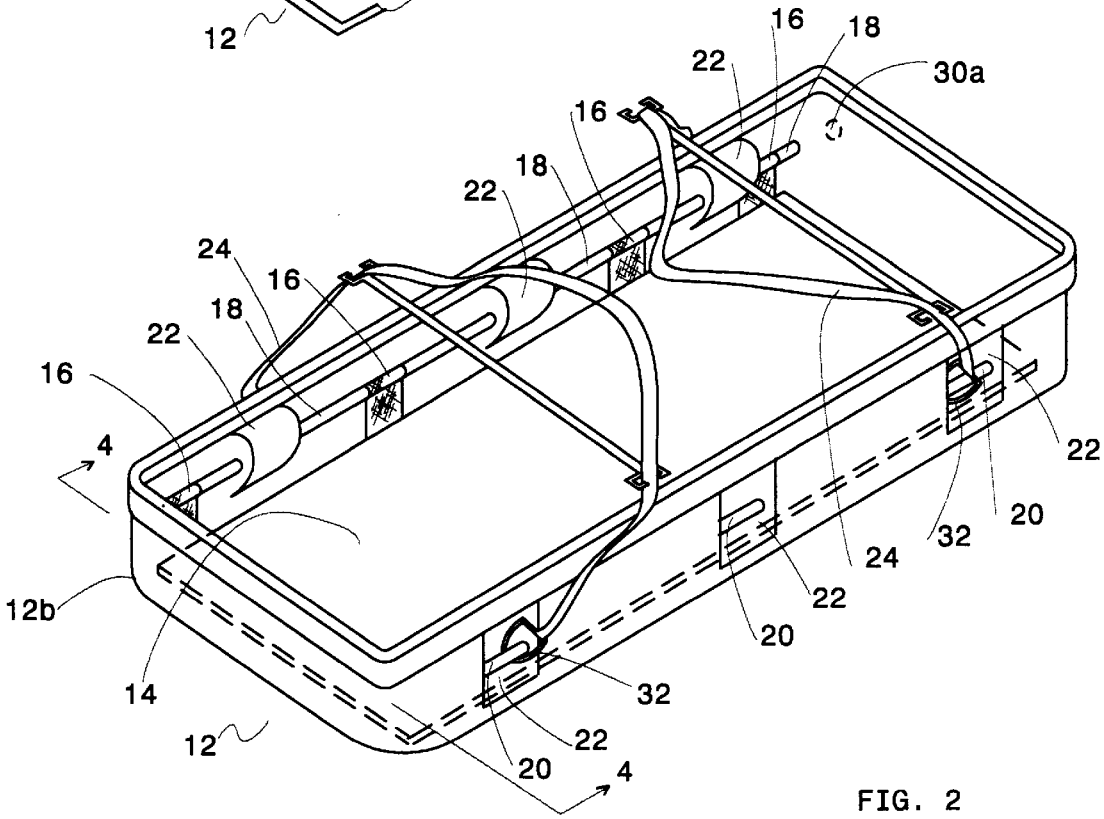
FIG. 2 is, in perspective view, the lower enclosure of the rescue shuttle of FIG. 1.

As seen in FIGS. 1–3, the rescue shuttle 10 of the present invention is an elongate container constructed of a non-structural composite shell or cowling 12. Within the shell a patient (not shown) is supported on a false floor 14 which forms a false floor within the shell. The false floor may be of structural sandwich construction such as a Gill panel. The false floor 14 is supported in the preferred embodiment by straps or webbing 16 strung laterally underneath the false floor and secured at their ends on either side of the shell by, for example, being looped over, and secured to, an opposed pair of longitudinally extending rigid members such as rods 18 and 20. Rods 18 and 20 form longitudinal compression tubes.

The shell is also supported by being mounted to rods 18 and 20. Rods 18 and 20 in the preferred embodiment, are journalled longitudinally and generally horizontally through vertical channels 22 so as to be exposed externally of shell 12 at longitudinally spaced apart locations along the sides of shell 12 corresponding to those locations where a helicopter sling harness 24 may be advantageously releasably attached to the shell. Because sling harness 24 attaches to rods 18 and 20 and the rods directly support false floor 14 by means of the support webbing 16, no structural loading of shell 12 results of the carrying of a patient on false floor 14. Consequently, the rescue shuttle of the present design is well suited to be accredited with a certificate of operational approval. The only loading that the shell must withstand is load conditions resulting from aerodynamic lift and drag, sling vibration and swing, rotor craft manoeuvering and varying gust, rain and wind conditions or the like.

Preferably, for helicopter slinging operations, an existing aircraft cargo hook, connected by a lanyard (not shown) to harness 24, will be used to support the rescue shuttle 10 in flight. Changes may, however, be required to the helicopter's primary quick release system to ensure that the inadvertent release of the rescue shuttle is improbable. The aircraft's backup quick release system may remain unchanged as an emergency backup in the event that the primary quick release is inadvertently actuated to thereby minimize the risk of loss of the rescue shuttle.

Figure 4:
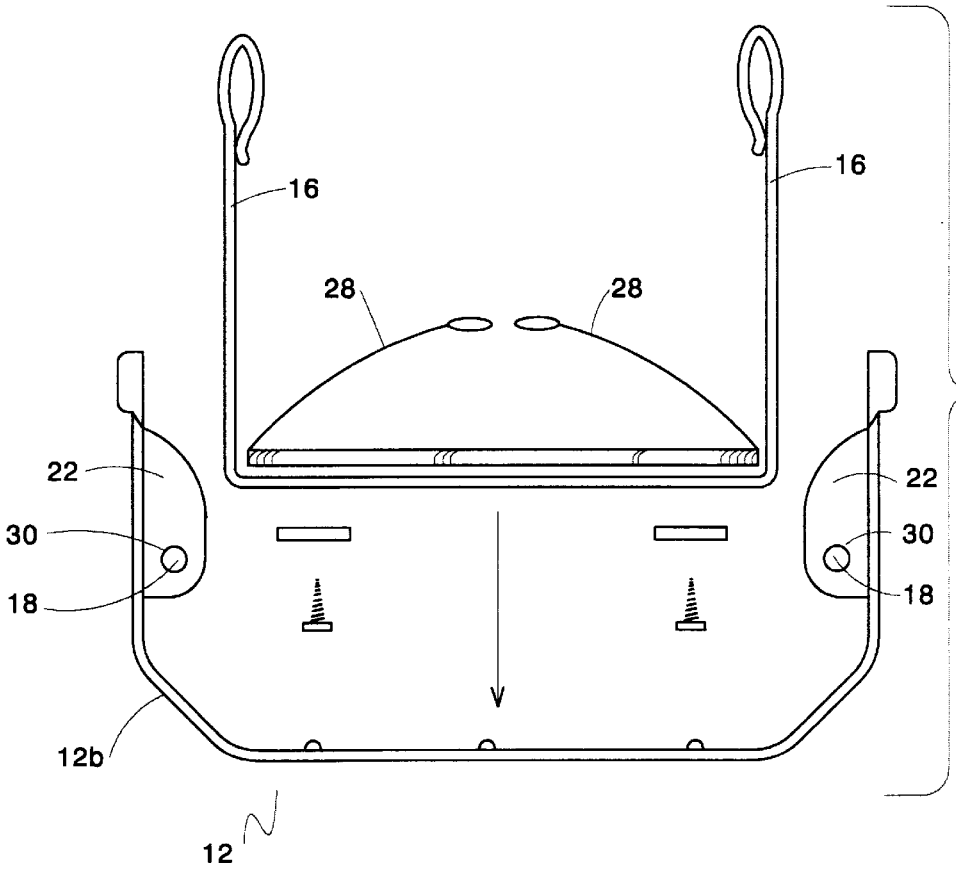
FIG. 4 is an exploded cross-section of the lower enclosure along line 4—4 in FIG. 2.
Figure 5:
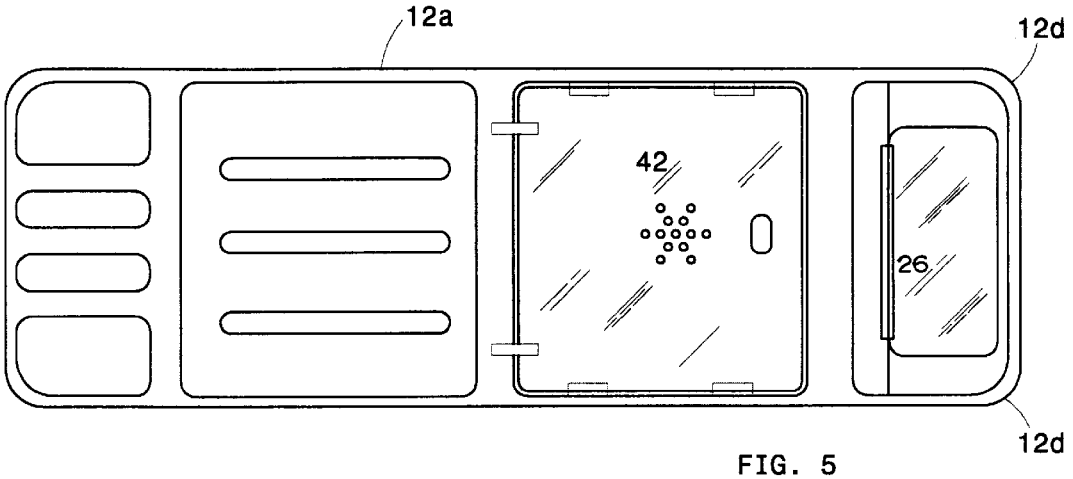
FIG. 5 is, in plan view, the rescue shuttle of FIG. 1 with harness removed.
Figure 6:
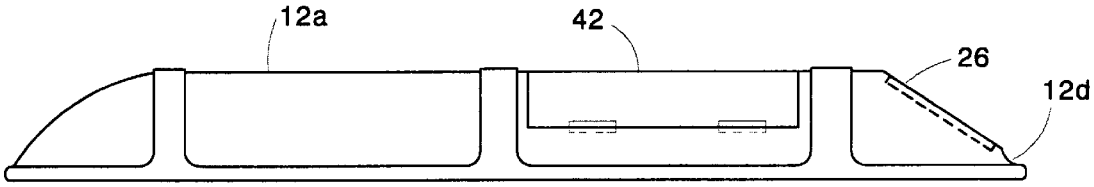
FIG. 6 is, in side elevation view, the upper enclosure of the rescue shuttle of FIG. 1.
Figure 7:
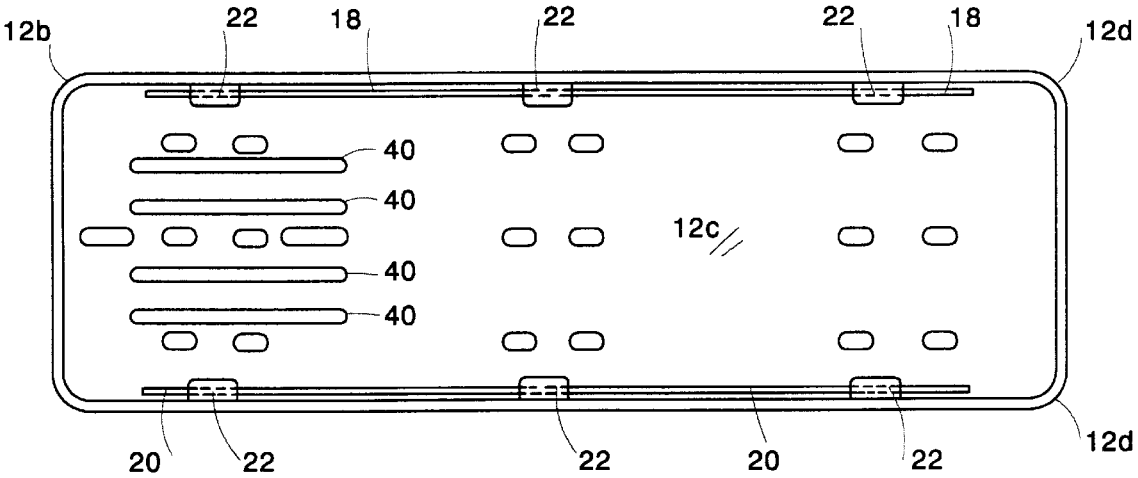
FIG. 7 is, in plan view, the lower enclosure of the rescue shuttle of FIG. 1.

The rescue shuttle is intended for use in the evacuation of an injured or otherwise incapacitated patient from a remote location so breathing and monitoring equipment may be releasably supported within enclosure 26 seen in FIG. 1, and patient restraints 28 seen in FIG. 4 are advantageously included in the preferred embodiment. The weight of such equipment may be also supported by rods 18 and 20 extending longitudinally along the sides of shell 12 as, primarily, shell 12, which may be of composite material, is designed to act as a fairing or cowling to protect the patient during flight and manual evacuation operations.

Shell 12 may be a generally rectangular shaped enclosure having aerodynamically rounded corners and being approximately 85 inches long, 25 inches wide and 17 inches high. The primary load carrying structure will consist of the false floor 14, which may be a Gill panel, that is, a rectangular panel having aluminum or composite facings over a balsa core. Rods 18 and 20 may be two longitudinal compression tubes, and in one embodiment, structurally spaced apart by means of two laterally extending compression tubes (not shown) which act as cross members mounted between the two longitudinal compression tubes so as to form a rectangular compression resistance structure.

To assemble shell 12 with rods 18 and 20, it may be necessary to slide rods 18 and 20 through sealable apertures 30*a* (one of which shown in dotted outline in FIG. 2) in the rear face of the lower cowling so as to journal rods 18 and 20 through apertures 30 in channels 22. The sealable apertures may then be plugged or otherwise sealed closed.

As explained above, false floor 14 is suspended within shell 12 from the longitudinal rods 18 and 20 by means of laterally extending webbing 16. Along either side of the shell, rods 18 and 20 are exposed externally by means of indentations, which may take the form of vertically extending channels (or pockets, grooves or the like) 22 in the shell. Rods 18 and 20 are journalled in snugly fitting apertures 30 on either side of the channels 22. Channels 22 may, in cross-section, be rounded or tear-drop shaped so as to avoid sharp edges which may chafe hands or harness 24. Advantageously, three such channels are formed on either side of the shell so as to form corresponding opposed pairs of channels, one pair at either end and one pair midway along the sides of the shell. Exposed rods 18 and 20 form external handholds as they pass through channels 22. The opposed pairs of such handholds on either end of the sides of the shell form attachment points for sling harness 24, releasably attachable by means of four carabineers 32. In one alternative embodiment, at one end of the shell may be mounted means for directionally stabilizing the rescue shuttle in flight along its longitudinal axis, such as by means of a tail fin (not shown) or a drag device, such as a small drag chute (not shown).

In addition to support webbing 16 passing underneath false floor 14, patient restraining straps 28 also may be passed underneath and mounted to false floor 14, the ends of the patient restraints being free to pass over a patient lying on the false floor for releasably restraining the patient thereon.

In use, an upper portion 12*a* of shell 12, which may be hinged to the lower portion 12*b* of shell 12 in a clamshell arrangement, is opened and the patient laid on to the false floor and restrained in place by at least two sets of patient restraints. At that time, the patient may be fitted with medically necessary breathing and monitoring equipment carried in enclosure 26 within shell 12, and covered with patient temperature maintaining means, such as reflective or electric blankets or the like. The upper portion 12*a* of the shell is then closed over the lower portion 12*b* and secured by means of latches 36, the sling harness 24 attached to the end-most handholds and the rescue shuttle then lifted out in a generally horizontal position vertically by a helicopter for transport to a medical facility.

Figure 8:
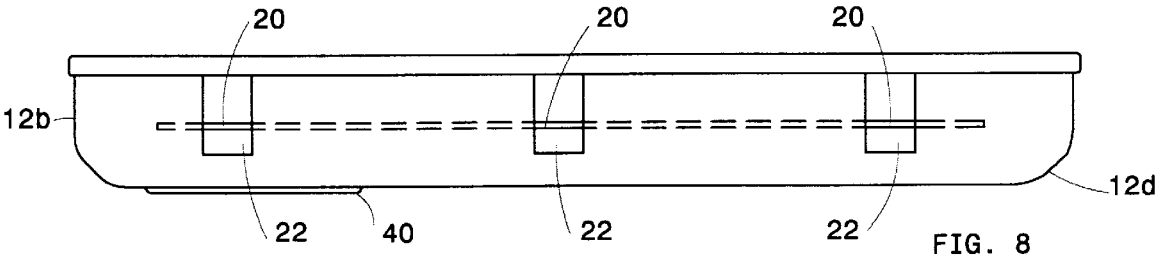
FIG. 8 is, in side elevation view, the lower enclosure of the rescue shuttle of FIG. 1.
Figure 16:
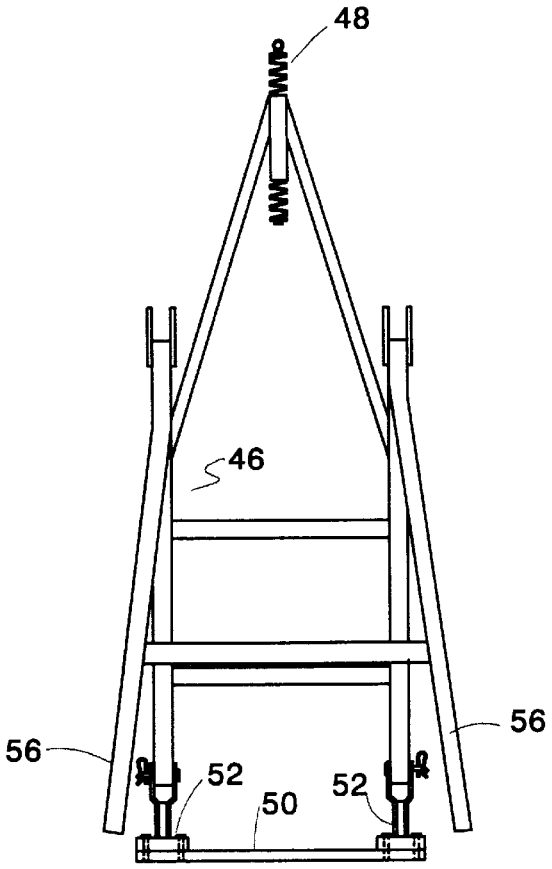
FIG. 16, in plan view, is the alternative embodiment of FIG. 15 with the handles folded.
Figure 15:
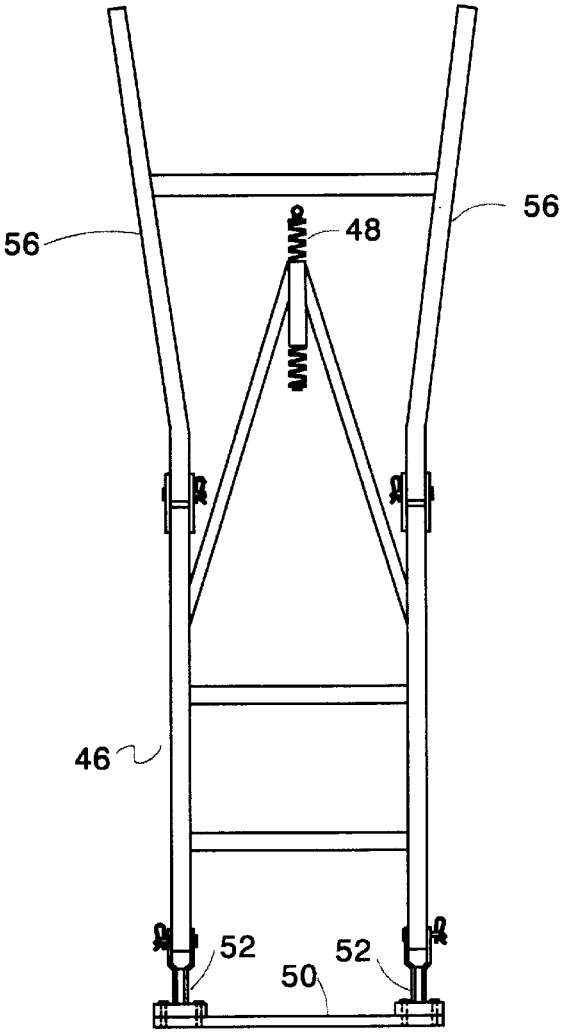
FIG. 15 is, in plan view, an alternative embodiment of the handles of FIG. 9.

Because it is anticipated that, for example in mountain rescue operations, the rescue shuttle may have to be slid over snow and ice, the underside of one end of the shell may be rounded or faired in the form of a toboggan, best seen in FIG. 8. Advantageously, the faired end of the rescue shuttle may coincide with the end of the shuttle intended to present the leading edge while in flight. In the preferred embodiment, the faired curve is of approximately 12 inch radius. The lower sides and rear may, preferably, be angled or rounded to approximate a 45 degree angled surface. The under surface 12*c* of the rescue shuttle along the lowermost surface of the shell may have longitudinally extending reinforcing ribs 40, ultra high molecular weight runners or the like. Thus, in one preferred embodiment, both the upper and lower surfaces at one end of the rescue shuttle are faired as by rounding of corners 12*d*, the interior of the shuttle at that end providing a suitable location for a medical equipment compartment. In one embodiment, the medical equipment compartment may be releasably removable from the shell so that the medical equipment may be transported independently of the shuttle to the patient.

Also, in a preferred embodiment, at least a portion of the upper surface of the shell provides a means of visibility for a patient restrained on the false floor and provides a means of ventilation of the interior of the shell. This may be accomplished by, for example, a Lexan (tm) panel 42 having small ventilation holes therein. Viewing panel 26 may also be provided in the shell corresponding with the medical equipment compartments so that the medical monitoring devices may be read from the outside while the shell is closed. Viewing panel 26 may be secured by releasable fasteners such as Velcro (tm) strips or the like so that the viewing panels may be replaced by non-perforated or non-transparent panels, or vice versa.

It has been found advantageous to limit the length of the runners 40 along the lowermost surface of the shell to allow for turning of the rescue shuttle while it is being dragged as a toboggan over ice and snow. Also, in an embodiment which is preferable for snow and ice operations, towing attachment points 44 may be provided at one end of the rescue shuttle, slightly below the centroidal longitudinal axis of the shell to which may be releasably attached a towing attachments 46 such as illustrated in FIGS. 9–16. Such attachments may have means for absorbing shock loading so as to prevent damage to the shell, for example, by means of a spring loaded eye bolt 48. Attachments 46 may be towing handles or harnesses mountable to lower shell 12*b* by means of plate 50 and tow eye 52 mountable onto plate 50. Attachments 46 may be releasably coupled to tow eye 52 by means of pins 54. Attachments 46 may have handles 56, which may be foldable to allow access to eye bolt 48 or to hook 58.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A rescue shuttle comprising:

an elongate lower enclosure cowling adapted for carrying a patient within said lower enclosure cowling, said lower enclosure cowling having a generally horizontal aperture defined by an upper edge thereof, an elongate upper enclosure cowling releasably mountable on to said lower enclosure cowling around said upper edge of said lower enclosure cowling so as to cover said generally horizontal aperture in said lower enclosure cowling, said lower enclosure cowling having laterally opposed first and second sides, said first side and said second side having corresponding first and second rigid members extending a longitudinally generally horizontally there along, rigidly mounted to said first side and second side respectively, a plurality of slinging straps mountable to said first and second rigid members in longitudinally spaced apart array for releasable suspension of said rescue shuttle beneath a helicopter, a plurality of false floor supporting members mountable to said first and second rigid members so as to extend between said first and second rigid members in longitudinally spaced array, a rigid false floor mountable onto said plurality of false floor supporting members.

2. The rescue shuttle of claim 1 wherein said first and second sides each have a plurality of channel means in a spaced longitudinal array along said first and second sides, said first and second rigid members journalled through said channel means so as to provide corresponding strap mounting locations on said first and second rigid members for mounting of said slinging straps and said false floor supporting members thereto, said strap mounting locations corresponding to said plurality of channel means.

3. The rescue shuttle of claim 2 wherein said first and second sides have corresponding first and second side surfaces extending in a longitudinal direction along said rescue shuttle, said first and second side surfaces laterally displaced on opposite sides of corresponding said first and second rigid members, laterally displaced in an alternating longitudinal array so as to form said channel means in a plurality of longitudinally spaced apart locations so as to alternatingly expose said first and second rigid members externally and internally of said lower enclosure cowling.

4. The rescue shuttle of claim 3 wherein a first set of said longitudinally spaced apart locations expose said first and second rigid members externally of said lower enclosure cowling, and wherein a second set of said longitudinally spaced apart locations expose said first and second rigid members internally of said lower enclosure cowling, wherein, said slinging straps are mountable at said first set of said longitudinally spaced apart locations to said first and second rigid members for vertical lifting of said rescue shuttle, and said first and second rigid members provide means for manual lifting of said rescue shuttle at said first set of said longitudinally spaced apart locations, and wherein, at said second set of longitudinally spaced apart locations said first and second rigid members provides means for suspending, within said lower enclosure cowling, said false floor supporting members, patient restraining means mountable to said rigid false floor for releasable restraining of said patient on said rigid false floor within said lower enclosure cowling between said first and second rigid members.

5. The rescue shuttle of claim 4 wherein said false floor supporting members are a plurality of longitudinally spaced apart flexible straps mounted to said first and second rigid members at said second set of longitudinally spaced apart locations and mounted to said rigid false floor.

6. The rescue shuttle of claim 5 wherein said rigid false floor is a rigid generally planar horizontally disposed member extending substantially the entire distance between said first and second sides and said flexible straps depend downwardly from, so as to extend continuously laterally between, said first and second rigid members, and beneath said rigid false floor.

7. The rescue shuttle of claim 6 further comprising medical equipment mountable within said lower enclosure cowling at a first end of said lower enclosure housing corresponding to an end enclosing the head of said patient and forming a leading end of said rescue shuttle when in flight.

8. The rescue shuttle of claim 1 wherein said first and second rigid members are longitudinal compression tubes.

9. The rescue shuttle of claim 8 wherein said rigid false floor is a gill panel.

10. The rescue shuttle of claim 1 further comprising longitudinally extending runners mounted to a lowermost surface of said lower enclosure cowling so as to protrude downwardly therefrom, wherein said runners extend only partially along the length of said lowermost surface.

11. The rescue shuttle of claim 10 wherein towing attachment means are mounted at a leading end of said lower enclosure cowling, and wherein said runners extend forwardly from a trailing end of said lower enclosure cowling opposite said leading end.

* * * * *